United States Patent [19]

Williams et al.

[11] 4,069,541

[45] Jan. 24, 1978

[54] CLEANING METHOD AND APPARATUS

[75] Inventors: Robert C. Williams; William R. Kimball, both of Smithfield, N.C.

[73] Assignee: U.S. Floor Systems, Inc., Raleigh, N.C.

[21] Appl. No.: 679,735

[22] Filed: Apr. 23, 1976

[51] Int. Cl.[2] ..... A47L 7/00

[52] U.S. Cl. ..... 15/321; 15/382

[58] Field of Search ..... 15/320, 321, 322, 382

[56] References Cited

U.S. PATENT DOCUMENTS

| | | | |
|---|---|---|---|
| 3,089,790 | 5/1963 | Balamuth et al. | 15/321 X |
| 3,608,108 | 9/1971 | Sawyer | 15/320 X |
| 3,609,787 | 10/1971 | Aurelio et al. | 15/320 X |
| 3,711,891 | 1/1973 | Conway | 15/382 X |
| 3,803,666 | 4/1974 | Sawyer | 15/320 |

FOREIGN PATENT DOCUMENTS

| | | | |
|---|---|---|---|
| 2,361,894 | 6/1975 | Germany | 15/320 |

*Primary Examiner*—Christopher K. Moore

*Attorney, Agent, or Firm*—Bell, Seltzer, Park & Gibson

[57] ABSTRACT

A liquid application and vacuum pick up cleaning apparatus wherein more thorough cleaning is facilitated by subjection of liquid on a surface being cleaned to agitation at ultrasonic frequencies for causing cavitation of the liquid.

5 Claims, 8 Drawing Figures

CLEANING METHOD AND APPARATUS

It has been proposed heretofore that surfaces, and particularly textile fabric surfaces such as carpet, upholstery and the like, be cleaned by methods and through the use of apparatus characterized as liquid spray and vacuum pick up methods and apparatus. One example of such a method and apparatus may be found in Emrick et al U.S. Pat. No. 3,883,301 issued May 13, 1975. To the extent that the disclosure of that prior patent is appropriate or necessary to a full understanding of the present invention, the disclosure to be there found is hereby incorporated by reference into the present specification.

While cleaning in accordance with the methods and through the use of apparatus as known heretofore has achieved some success, it continues to be desirable to maximize the effectiveness of such cleaning. Accordingly, it is an object of the present invention to improve liquid application and vacuum pick up cleaning apparatus in such a manner as to facilitate more thorough cleaning. In realizing this object of the present invention, liquid applied to a surface to be cleaned is subjected to agitation at ultrasonic frequencies for causing cavitation of the liquid prior to vacuum removal of liquid from the surface. Such agitation and cavitation of liquid actively disperses liquid over a surface and throughout fibers to be cleaned.

Some of the objects of the invention having been stated, other objects will appear as the description proceeds, when taken in connection with the accompanying drawings, in which FIG. 1 is a perspective view of an apparatus embodying the present invention;

Figure 1:
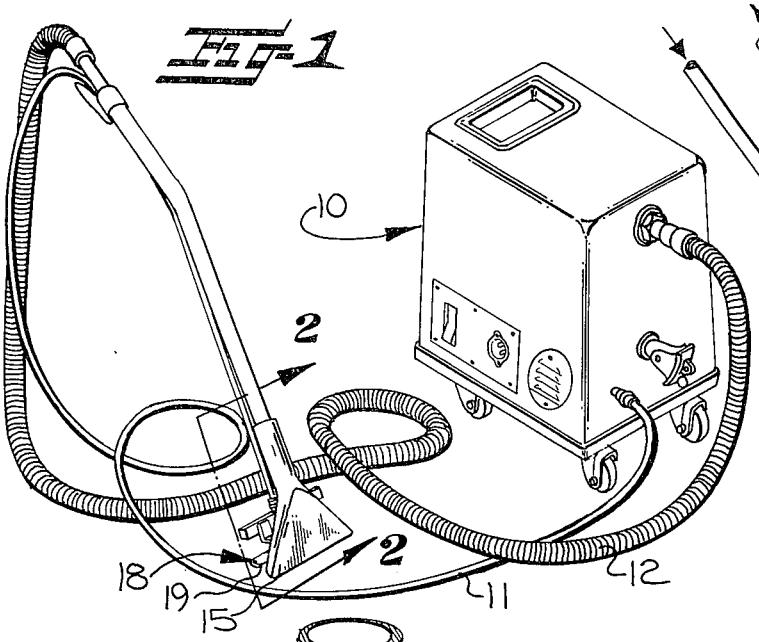
Figure 2:
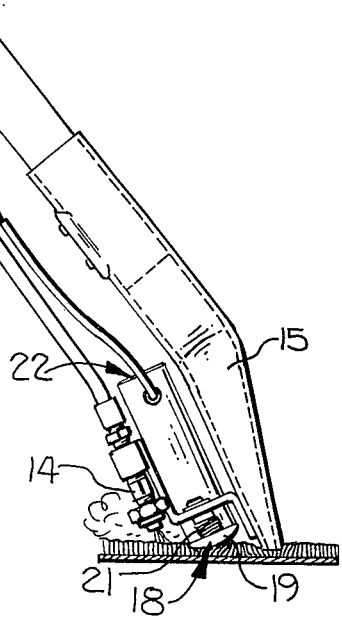
FIG. 2 is a side elevation view of a spraying and vacuum head for the apparatus of FIG. 1, taken generally as indicated by the line 2—2 in FIG. 1.
Figure 3:
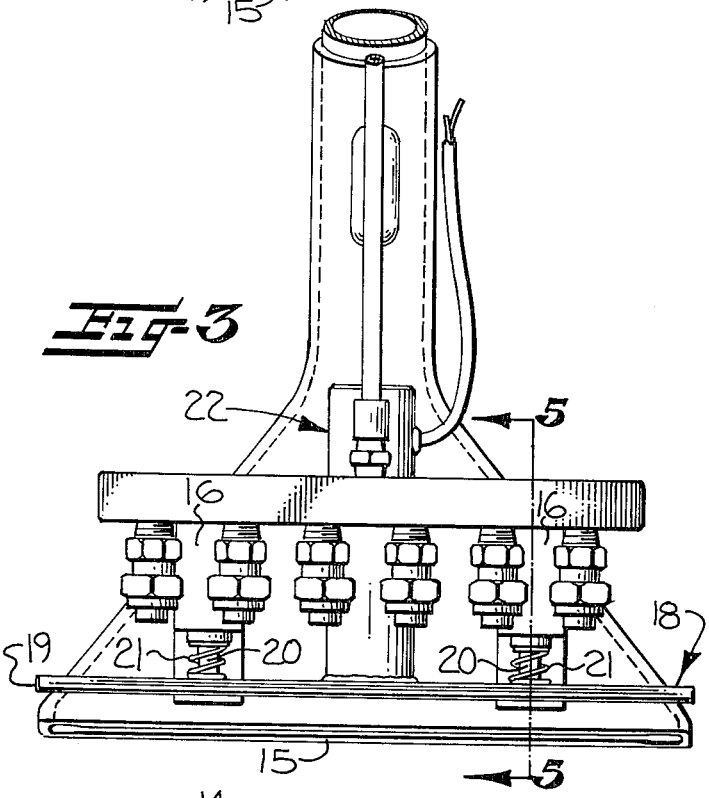
FIG. 3 is an enlarged elevation view of the head of FIGS. 1 and 2.
Figure 5:
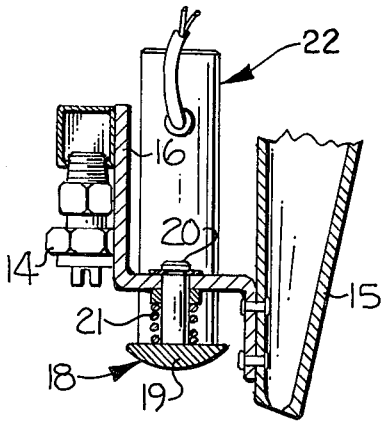
FIG. 5 is an enlarged elevation view, partly in section, taken generally along the line 5—5 in FIG. 3.
Figure 4:
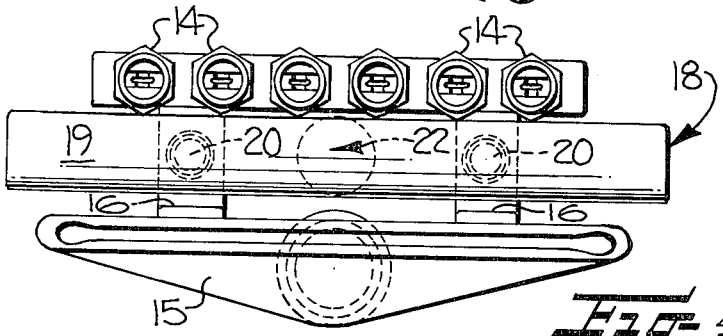
FIG. 4 is a view from below of the head of FIGS. 2 and 3.

Referring now more particularly to the accompanying drawings, the apparatus there shown in FIGS. 1–5 is particularly adapted for performing a method of cleaning wherein liquid is sprayed onto a surface to be cleaned and then immediately sucked from the surface. More particularly, an appropriate liquid pump and suction air impeller, together with drive motors therefor, are contained within a housing generally indicated at 10 and therefore are not visible in the present drawing. Liquid, preferably a solution of hot water and an appropriate detergent or other cleaning agent, is delivered through a liquid conduit 11, while suction air flows are induced through a suction conduit 12. By means of an appropriate wand and valve, liquid is delivered to spray nozzle means shown as a plurality of nozzles 14 mounted at an operating head. With the delivery of liquid to the spray nozzles 14, droplets of liquid are sprayed toward the surface to be cleaned. The present invention contemplates that such surfaces generally will be fibrous textile material surfaces such as a floor covering carpet as generally indicated at C in FIG. 2 or a furniture covering upholstery fabric (not shown). However, the present invention has been demonstrated to facilitate improved cleaning of other surfaces including resilient floor coverings of plastic sheet form and essentially rigid surfaces such as concrete. In accordance with the present invention, droplets of liquid sprayed toward the surface by the nozzles 14 impinge on the surface at a first location, creating at that location a wetted zone.

The head additionally includes a vacuum nozzle 15 for drawing air and liquid from a suction zone closely adjacent the surface to be cleaned. By means of mounting brackets 16 connecting the spray nozzles 14 and vacuum nozzle 15, the location of liquid impingement or wetted zone and the location of sucking of liquid from the surface to be cleaned or suction zone are maintained in a predetermined spaced relation. In normal use of those components of the apparatus described to this point, liquid is sprayed onto a surface to be cleaned during movement of the cleaning head thereacross, and soiled liquid is promptly withdrawn from the surface through the suction nozzle.

In accordance with the present invention, cleaning of the surface is enhanced by subjecting liquid on the surface intermediate the wetted and suction zones to agitation at ultrasonic frequencies for causing cavitation of the liquid. It has been discovered that such cavitation of the liquid during the brief residence time of liquid on the surface improves the effectiveness of the cleaning performed by the liquid application and vacuum pick up method and apparatus described hereinabove. While the precise physical process which results in enhanced cleaning is not fully or clearly understood, it is believed that cavitation of the liquid results in a deaerating atomization or breaking up of the liquid droplets into exceedingly fine particles which are brought into more active engagement with the surface and material to be cleaned as a result of the occurrence of cavitation.

In order to achieve the enhanced cleaning contemplated by the present invention, a means for subjecting liquid to agitation at ultrasonic frequencies is provided and preferably comprises bar means in the form of an elongate member generally indicated at 18 and mounted from the brackets 16 for extending transversely of the head at a location intermediate the spray nozzles 14 and the vacuum nozzle 15. Preferably, the elongate member 18 has a curved lower surface 19 for engaging carpet or some other surface to be cleaned substantially along a line widthwise of the zone in which suction is exerted by the suction nozzle 15. Additionally, the elongate bar member 18 is preferably mounted from the brackets 16 by a pair of studs 20 each penetrating a corresponding bracket and each encircled by a biasing spring 21 which urges the member 18 toward an extended position. As will be appreciated (particularly from FIG. 2), the head of an apparatus in accordance with this invention may be moved into various angular positions relative to the surface being cleaned. The provision of a yieldable mounting means for the bar member 18, as described hereinabove, facilitates avoidance of that member acting as a fulcrum or pivot point to cause lifting of the suction nozzle 15 from the surface being cleaned.

The bar 18 additionally has operatively connected therewith suitable means for driving the bar with ultrasonic frequency mechanical vibration. Preferably, the vibration generating means comprises electrical oscillator means (not shown) for generating oscillating electrical currents having frequencies above 18 kilohertz and transducer means (generally indicated at 22) electrically connected with the oscillator means and mechanically connected with the bar member 18 for converting the oscillating electrical currents into mechanical vibration. Such oscillator circuits and suitable magnetostrictive or the like transducers are available from sources such as the Branson Instruments, Inc. of Stamford, Conn. and interested readers are directed to literature available from that source should additional information be deemed desirable. A preferred range for the ultrasonic frequencies applied to the bar member 18 is the range of from about 20 to about 50 kilohertz. Such frequencies are, as is generally known, above the normal upper frequency threshold for human hearing and for that reason have been conventionally referred to heretofore as "ultrasonic".

Figure 6:
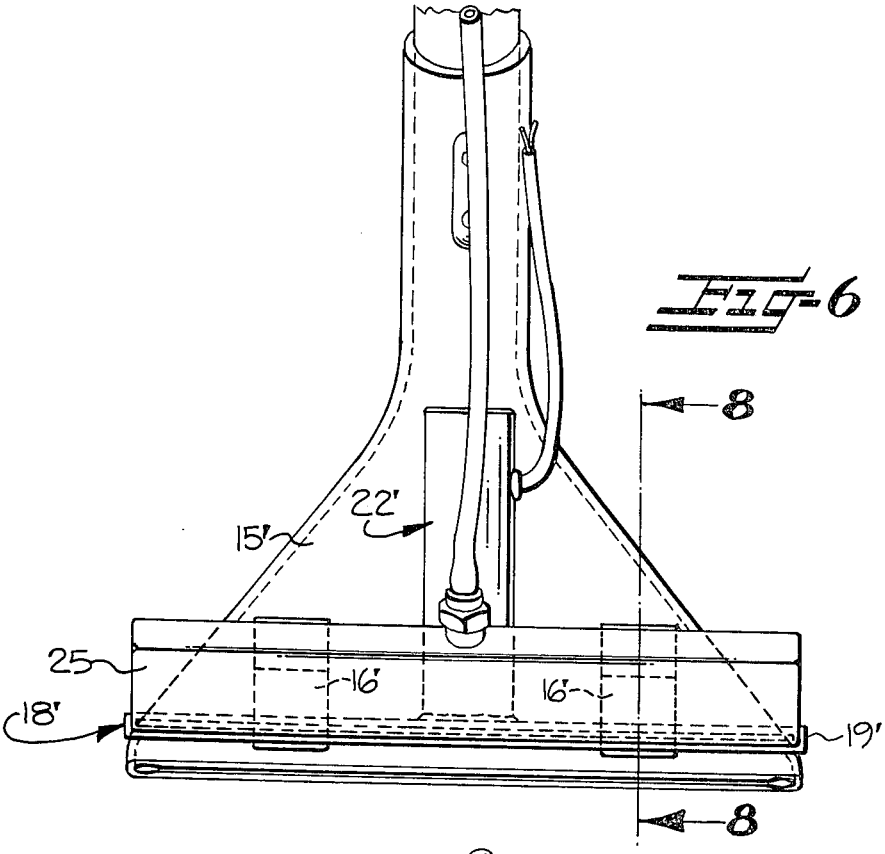
FIG. 6 is a view similar to FIG. 3 showing a modified form of a vacuum head for the apparatus of FIG. 1.
Figure 7:
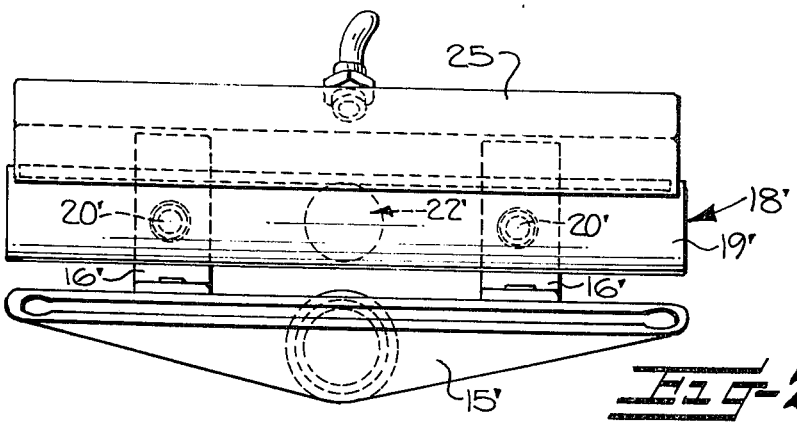
FIG. 7 is a view similar to FIG. 4 of the head of FIG. 6.
Figure 8:
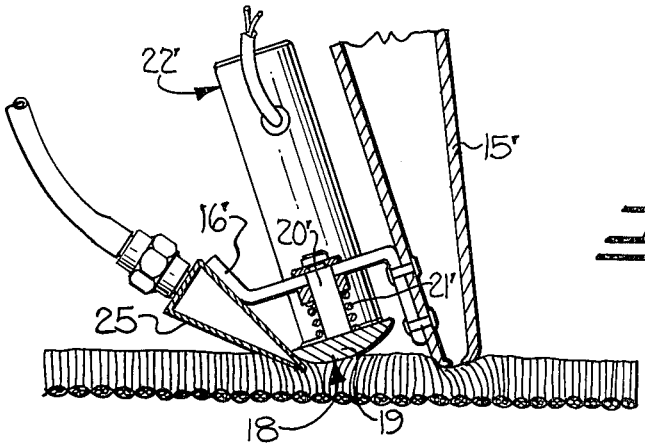
FIG. 8 is a side elevation view similar to FIG. 2 and showing the head of FIGS. 6 and 7, taken generally as indicated by the line 8—8 in FIG. 6.

While described to this point with reference to a head in which spray nozzles are used for applying liquid, it is contemplated that it may be preferred to minimize introduction of air into the liquid being applied. In such circumstances, it is preferred that another form of head, as illustrated more particularly in FIGS. 6–8, be used. Components of the head of FIGS. 6–8 corresponding to components of the head of FIGS 1–5 have been identified by common reference characters with the addition of prime notation, and the description which follows will be particularly directed to the distinguishing features of the two forms of heads embodying this invention.

Liquid delivered to the wetted zone by the second form of head passes through a manifold 25 and is sheeted beneath or across the surface 19' of the elongate bar 18'. When so delivered, aeration of the liquid is minimized while the cleaning agent is pooled or puddled in the active zone beneath the bar 18'.

In the drawings and specification, there has been set forth a preferred embodiment of the invention, and although specific terms are employed, they are used in a generic and descriptive sense only and not for purposes of limitation.

That which is claimed is:

1. Apparatus for liquid application and vacuum pick up cleaning of textile materials comprising means for directing liquid toward a textile material surface to be cleaned and for applying liquid to the surface in a wetted zone at a first location and in an elongated zone pattern, vacuum nozzle means for drawing air and liquid from a suction zone closely adjacent the surface and connected with said liquid directing means in fixed relation thereto for sucking liquid from the textile material surface at a second location spaced from said first location and spanning substantially said elongated wetted zone pattern, bar means for subjecting liquid on the surface intermediate said first and second locations to agitation at ultrasonic frequencies for causing cavitation of the liquid and thereby facilitating improved cleaning of the surface, and yieldable mounting means operatively interconnecting said bar means with said fixedly related liquid directing means and vacuum nozzle means for maintaining operational positional relationships thereamong while accommodating a range of angular positions of said nozzle means relative to the surface being cleaned.

2. In a hot water vacuum extraction carpet cleaning apparatus having pump means for supplying a flow of a pressurized solution of hot water and a detergent, vacuum means for inducing a suction flow of air, and cleaning head means for engaging carpet to be cleaned, said cleaning head means having means operatively communicating with said pump means for applying solution to carpet in a wetted zone at a first location, and said cleaning head means further having vacuum nozzle means operatively communicating with said vacuum means for drawing air and solution from a suction zone closely adjacent the carpet and for sucking solution from the carpet at a second location spaced from said first location, improvements which facilitate more thorough cleaning comprising means mounted on said cleaning head means for causing deaerating cavitation of solution on the carpet intermediate the first and second locations by transmitting to the solution mechanical vibration at ultrasonic frequencies, and further wherein said means for applying solution comprises a manifold for applying the solution to carpet in the form of a sheet beneath said deaerating cavitation means.

3. Apparatus according to claim 2 wherein said vacuum nozzle defines a predetermined width for said suction zone and further wherein said cavitation causing means comprises means for generating ultrasonic frequency vibration and an elongate bar member having a length spanning substantially said suction zone width and being mounted thereadjacent, said bar member engaging carpet being cleaned and being operatively connected with said vibration generating means.

4. Apparatus according to claim 3 wherein said vibration generating means comprises electrical oscillator means for generating oscillating electrical currents having frequencies above eighteen kilohertz, and transducer means electrically connected with said oscillator means and mechanically connected with said bar member for converting said oscillating electrical currents into mechanical vibration.

5. Apparatus according to claim 3 wherein said elongate bar member defines a curved lower surface for engaging carpet substantially along a line widthwise of said suction zone.

* * * * *

UNITED STATES PATENT AND TRADEMARK OFFICE

CERTIFICATE OF CORRECTION

PATENT NO. : 4,069,541

DATED : January 24, 1978

INVENTOR(S) : Robert C. Williams et al.

It is certified that error appears in the above—identified patent and that said Letters Patent is hereby corrected as shown below:

On The Title Page and Column 1, title of invention should read -- CLEANING APPARATUS --.

Signed and Sealed this

*Seventeenth* Day of *November 1981*

[SEAL]

*Attest:*

GERALD J. MOSSINGHOFF

*Attesting Officer*

*Commissioner of Patents and Trademarks*